US012595961B2

(12) United States Patent
Ranchoux et al.

(10) Patent No.: US 12,595,961 B2
(45) Date of Patent: Apr. 7, 2026

(54) AIR SEPARATION APPARATUS

(71) Applicant: L'Air Liquide, Societe Anonyme pour l'Etude et l'Exploitation des Procedes Georges Claude, Paris (FR)

(72) Inventors: Maxime Ranchoux, Hangzhou (CN); Shinji Tomita, Kobe (JP)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 265 days.

(21) Appl. No.: 18/118,381

(22) Filed: Mar. 7, 2023

(65) Prior Publication Data

US 2023/0280093 A1 Sep. 7, 2023

(30) Foreign Application Priority Data

Mar. 7, 2022 (JP) ..... 2022-34094

(51) Int. Cl.
*F25J 3/04* (2006.01)

(52) U.S. Cl.
CPC ..... *F25J 3/04721* (2013.01); *F25J 3/04412* (2013.01); *F25J 3/04806* (2013.01);
(Continued)

(58) Field of Classification Search
CPC .. F25J 3/04721; F25J 3/04412; F25J 3/04806; F25J 2210/40; F25J 2215/42; F25J 2215/58; F25J 2245/02; F25J 2200/20; F25J 2245/42; F25J 2245/50; F25J 3/04678; F25J 3/04727; F25J 3/04315; F25J 3/04654; F25J 3/04872; F25J 3/0489; F25J 3/04048;
(Continued)

(56) References Cited

U.S. PATENT DOCUMENTS 4,433,990 A * 2/1984 Olszewski ..... F25J 3/04969 62/648
4,822,395 A * 4/1989 Cheung ..... F25J 3/04715 62/647
(Continued)

FOREIGN PATENT DOCUMENTS

CN 203928597 U * 11/2014
CN 115493359 A * 12/2022
(Continued)

*Primary Examiner* — Jianying C Atkisson
*Assistant Examiner* — Ibrahim A. Michael Adeniji
(74) *Attorney, Agent, or Firm* — Justin K. Murray

(57) ABSTRACT

An air separation apparatus comprises: a first rectification column, a first condensing portion, a second rectification column, a third rectification column, a second condensing portion, a fourth rectification column, a third condensing portion, and a recycling pipe for recycling a gas drawn from the third condensing portion to the second rectification column. The air separation apparatus furthermore comprises: a branch pipe branching from the recycling pipe; and a control unit for controlling opening/closing of a valve so that a gas drawn from the third condensing portion is fed to the branch pipe for a predetermined period from the start of driving of the third condensing portion, and for controlling opening/closing of the valve so that the gas drawn from the third condensing portion is fed to the recycling pipe after the predetermined period has elapsed.

8 Claims, 1 Drawing Sheet

(52) U.S. Cl.
CPC ..... *F25J 2210/40* (2013.01); *F25J 2215/42* (2013.01); *F25J 2215/58* (2013.01); *F25J 2245/02* (2013.01)

(58) Field of Classification Search
CPC .... F25J 3/04066; F25J 3/0423; F25J 3/04321; F25J 2250/20
See application file for complete search history.

(56) References Cited

U.S. PATENT DOCUMENTS 5,207,066 A * 5/1993 Bova ..... F25J 3/04351 62/924
5,228,296 A * 7/1993 Howard ..... F25J 3/04666 62/646
5,522,224 A * 6/1996 Canney ..... F25J 3/048 62/924
5,784,899 A * 7/1998 Nojima ..... F25J 3/0469 62/648
5,809,802 A * 9/1998 Rathbone ..... F25J 3/04678 62/646
9,222,726 B2 * 12/2015 Howard ..... F25J 3/04024
2013/0053998 A1 * 2/2013 Singhal ..... F25J 3/04848 700/108
2019/0293347 A1 9/2019 Hirose et al.
2021/0207885 A1 * 7/2021 Kaneda ..... F25J 3/04303
2021/0278132 A1 * 9/2021 Kaneda ..... F25J 3/04412

FOREIGN PATENT DOCUMENTS

DE 10341552 A1 * 10/2004 ..... F25J 3/04412
JP 2004-251 569 9/2004
JP 6 557 763 8/2019
JP 2021-110 466 8/2021

* cited by examiner

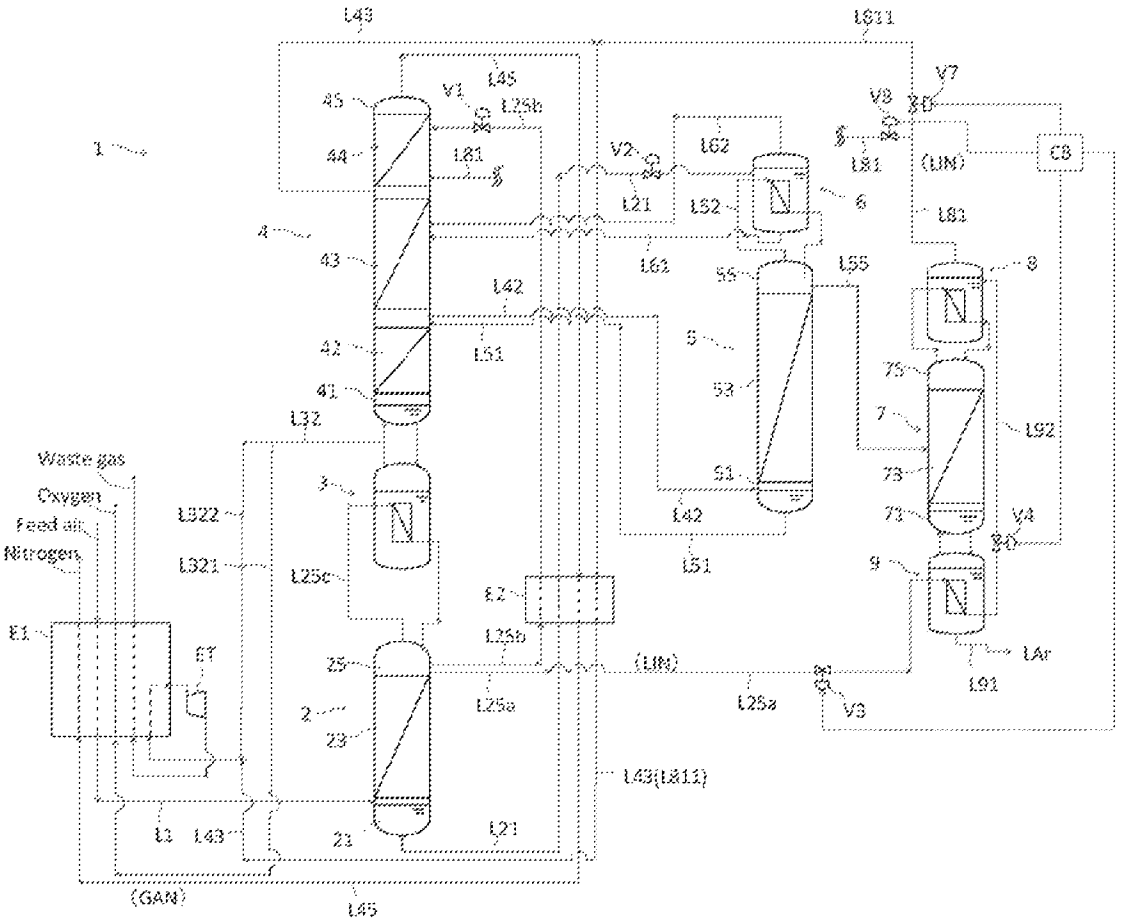
Waste gas
Oxygen
Feed air
Nitrogen
(GAN)
(LIN)
(LIN)
L43(L811)

AIR SEPARATION APPARATUS

CROSS REFERENCE TO RELATED APPLICATIONS

This application claims the benefit of priority under 35 U.S.C. § 119 (a) and (b) to Japanese patent application No. JP2022-34094, filed Mar. 7, 2022, the entire contents of which are incorporated herein by reference.

FIELD OF THE INVENTION

The present disclosure relates to an air separation apparatus. In particular, the present disclosure relates to an air separation apparatus comprising a crude argon rectification column and a pure argon rectification column.

BACKGROUND OF THE INVENTION

Conventionally, an oxygen-rich gas-liquid substance containing argon extracted from an air separation apparatus is fed to an argon rectification column from which high-purity product argon liquid is extracted.

JP 6557763 and JP 2021-110466 describe an air separation apparatus comprising: a first rectification column having a first condenser, a second rectification column, a crude argon rectification column having a second condenser, and a pure argon rectification column.

JP 644023, US 2019/0293347, and JP 2004-251569 describe an air separation apparatus comprising: a first rectification column having a first condenser, a second rectification column, and a crude argon rectification column having a second condenser.

A pure argon rectification column is provided in JP 6557763 and JP 2021-110466, but there is no description of a waste gas used in the pure argon rectification column. JP 644023, US 2019/0293347, and JP 2004-251569 all relate to an air separation apparatus that does not have a pure argon rectification column. [Summary of the Invention]

SUMMARY OF THE INVENTION

In an air separation apparatus for simultaneously producing high-purity nitrogen and high-purity argon, the argon is produced at high purity from a feed gas (a gas containing argon, oxygen and nitrogen) fed to the pure argon rectification column, and the waste gas therefrom contains nitrogen. When the pure argon rectification column is configured to be capable of functioning (starting and stopping) independently of other rectification columns, this makes the piping more complex (narrow pipes, dead-end pipelines). There is a risk of contamination of the air separation apparatus as a result. Recovery of nitrogen gas from the waste gas is therefore a concern.

Meanwhile, it would be desirable to recover nitrogen gas contained in the gas drawn from the condensing portion of the pure argon rectification column.

In light of the situation described above, the objective of the present disclosure lies in providing an air separation apparatus comprising a crude argon rectification column and a pure argon rectification column, which is capable of recovering nitrogen from a gas drawn from a condensing portion of the pure argon rectification column; and a method for recovering nitrogen from the gas drawn from the condensing portion of the pure argon rectification column.

An air separation apparatus (1) according to the present disclosure comprises: a first rectification column (2) into which feed air is introduced; a first condensing portion (3) for condensing nitrogen gas drawn from a column top (25) of the first rectification column (2); a second rectification column (4) into which is introduced a nitrogen-containing liquid drawn from an upper stage of a rectification portion (23) or the column top (25) of the first rectification column (2) (the nitrogen-containing liquid is introduced into an upper-stage rectification portion (44) or an intermediate rectification portion (43)); a third rectification column (5) into which is introduced an argon-containing oxygen-rich substance (which may be gaseous, liquid or a gas-liquid mixture) drawn from a lower-stage rectification portion (42) or the intermediate rectification portion (43) of the second rectification column (4); a second condensing portion (6) for condensing a gas drawn from a column top (55) of the third rectification column (5); a fourth rectification column (7) into which is introduced an argon-rich substance (which may be gaseous, liquid or a gas-liquid mixture) drawn from a rectification portion (53) (from an intermediate stage to an upper stage) or the column top (55) of the third rectification column (5); a third condensing portion (8) into which is introduced a gas drawn from a column top (75) of the fourth rectification column (7); and a recycling pipe (L81) for recycling a gas (nitrogen-containing gas) drawn from the third condensing portion (8) to (the intermediate rectification portion (43) or the upper-stage rectification portion (44) of) the second rectification column (4).

The third rectification column may be referred to as a crude argon rectification column, and the fourth rectification column may be referred to as a pure argon rectification column.

The first condensing portion (3) may be provided in an upper portion of the first rectification column (2). The second condensing portion (6) may be provided in an upper portion of the third rectification column (5). The third condensing portion (8) may be provided in an upper portion of the fourth rectification column (7).

Feed air may be introduced from a warm end of a main heat exchanger (E1), pass through a cold end, and be introduced into a column bottom (21) of the first rectification column (high-pressure column (2)). The feed air may be treated in an air purification unit to remove impurities, etc. before being introduced into the main heat exchanger (E1).

A branch pipe (L811) branching from the recycling pipe (L81) may be provided.

A valve may be provided in the recycling pipe (L81) or/and the branch pipe (L811). A valve (three-way valve) may be provided at a branching position.

The air separation apparatus 1 may comprise a control unit (C8) for controlling opening/closing of the valve so that a gas drawn from the third condensing portion (8) is fed to the branch pipe (L811) for a predetermined period from the start of driving of the third condensing portion (8), and for controlling opening/closing of the valve so that the gas drawn from the third condensing portion (8) is fed to the recycling pipe (L81) after the predetermined period has elapsed.

The air separation apparatus (1) may comprise a reboiler (9) into which is introduced a nitrogen-containing liquid (LIN) drawn from a rectification upper stage of the first rectification column (2). A drawing pipe (L91) for drawing liquid argon (high-purity argon liquid) from a lower portion of the reboiler (9) may be provided in the reboiler (9). The reboiler (9) may be provided in a lower portion of the fourth rectification column (7), or it may be provided outside the column.

An introduction pipe (L92) may be provided for introducing a gas drawn from the reboiler (9) into the third condensing portion (8). A decompression means (V4) may be provided in the introduction pipe (L92).

An oxygen-rich liquid drawn from the column bottom (21) of the first rectification column (2) may be introduced into a rectification upper stage or column top of the third rectification column (5), or into the second condensing portion (6).

The third rectification column (5) may be separated into two or more columns, or it may be configured by a single column.

The second rectification column (4) may be separated into two or more columns, or it may be configured by a single column.

A subcooler (E2) may also be provided, and two or more of the following liquids/gases may be introduced therein: a nitrogen-containing liquid which is drawn from the column top (25) from an upper stage of the rectification portion (23) of the first rectification column (2), and is introduced into the second rectification column (4), an oxygen-rich liquid which is drawn from the column bottom (21) of the first rectification column (2), and is introduced into the rectification upper stage or column top of the third rectification column (5), the second condensing portion (6), or an additional rectification column (5*a*), high-purity nitrogen gas drawn from a column top (45) of the second rectification column (4), a waste gas drawn from an upper stage or intermediate stage of the second rectification column (4), and a waste gas (that is, used nitrogen-containing liquid) circulating through the branch pipe (L811), the abovementioned two or more liquids/gases undergoing heat exchange with each other in the subcooler (E2).

The control unit (C8) may also serve as a device for controlling the air separation apparatus. The control unit (C8) may be configured by a dedicated device, an information processor (e.g., a cloud server, an on-premises server, or a general-purpose computer, etc.), a device for collaboration between software and hardware (a memory and a processor), and firmware, etc.

A method for recovering nitrogen gas from a waste gas used in a condensing portion of a pure argon rectification column of the present disclosure comprises: a step in which a gas drawn from the third condensing portion of the air separation apparatus, which comprises the first rectification column (high-pressure rectification column), the second rectification column (low-pressure rectification column), the crude argon rectification column, the pure argon rectification column, the first condensing portion, the second condensing portion, the third condensing portion, and the reboiler, is recycled to the second rectification column whereby nitrogen is recovered from said gas.

The gas drawn from the third condensing portion is a gas based on the nitrogen-containing liquid (LIN) which is drawn from the rectification upper stage of the first rectification column and introduced into the third condensing portion via the reboiler.

The above method may comprise: a driving-start time control step in which the gas drawn from the third condensing portion is not recycled for a predetermined period after the start of driving of the third condensing portion, and the gas drawn from the third condensing portion is recycled to the second rectification column after the predetermined period has elapsed.

The gas drawn from the third condensing portion (8) can be recycled to the second rectification column (4), whereby impurities in the gas can be refined (removed) in the second rectification column (4) so that nitrogen can be recovered, and the nitrogen recovery rate can be improved.

Furthermore, in certain embodiments, at the start of driving of the third condensing portion (8), the gas is treated without being fed to the second rectification column, whereby the gas can be rectified after a standby for stable operation of the second rectification column (4).

BRIEF DESCRIPTION OF THE DRAWINGS

Further developments, advantages and possible applications of the invention can also be taken from the following description of the drawing and the exemplary embodiments. All features described and/or illustrated form the subject-matter of the invention per se or in any combination, independent of their inclusion in the claims or their back-references.

FIG. 1 illustrates an air separation apparatus according to embodiment 1.

DETAILED DESCRIPTION OF THE INVENTION

Several embodiments of the present invention will be described below. The embodiments described below are examples of the present invention. The present invention is in no way limited by the following embodiments, and also includes a number of variant modes which are implemented within a scope that does not alter the gist of the present invention. It should be noted that not all of the components described below are necessarily essential components of the present invention.

Embodiment 1

An air separation apparatus 1 according to embodiment 1 will be described below with the aid of FIG. 1. The air separation apparatus 1 comprises: a main heat exchanger E1, a first rectification column (high-pressure rectification column) 2, a second rectification column (low-pressure rectification column) 4, a third rectification column (first crude argon rectification column) 5, a fourth rectification column 7 (pure argon rectification column), a first condensing portion 3, a second condensing portion 6, a third condensing portion 8, a reboiler 9, and a subcooler E2. The first rectification column 2 may be referred to as a high-pressure rectification column because it performs rectification at a higher pressure than the second rectification column 4, and the second rectification column 4 may be referred to as a low-pressure rectification column.

(High-Pressure Rectification Column)

Feed air passes through the main heat exchanger E1 and is introduced via a pipe L1 into a column bottom 21 or a lower stage of a rectification portion 23 of the first rectification column 2. The feed air is separated into an oxygen-rich liquid and a nitrogen-containing liquid (LIN) in the first rectification column 2.

The first condensing portion (nitrogen condenser) 3 condenses (liquefies) nitrogen gas drawn from a column top 25 of the first rectification column 2 via a pipe L25*c*, and returns the condensed gas to the first rectification column 2. Oxygen gas constituting a portion drawn from the column top of the first condensing portion (nitrogen condenser) 3 is fed to a column bottom 41 or a lower-stage rectification portion 42 of the second rectification column 4. Another portion drawn from the column top of the first condensing portion 3 is introduced, via a pipe L32 and a branch pipe L321 thereof, into the main heat exchanger E1 where it undergoes heat exchange, and can then be extracted as product oxygen (oxygen). A further portion is introduced, via a branch pipe L322 of the pipe L32, into the main heat exchanger E1 where it undergoes heat exchange and is then expelled as a waste gas. A valve may be provided in one or both of the branch pipe L321 and the branch pipe L322.

The oxygen-rich liquid is drawn from the column bottom 21 of the first rectification column 2 via a pipe L21 and undergoes heat exchange in the subcooler E2, after which it is introduced into a rectification portion or a column top of the third rectification column 5. A valve V2 is provided in the pipe L21 and functions as a flow rate control valve or an opening/closing gate valve.

The nitrogen-containing liquid (LIN) is drawn from the column top 25 of the first rectification column 2 via a pipe L25*b* and undergoes heat exchange in the subcooler E2, after which it is introduced into an upper-stage rectification portion 44 of the second rectification column 4.

A valve V1 is provided in the pipe L25*b* and functions as a flow rate control valve or an opening/closing gate valve. The valve V1 may be controlled by means of a control unit C8.

Furthermore, the nitrogen-containing liquid (LIN) is drawn from the column top 25 of the first rectification column 2 via a pipe L25*a* and is introduced into the reboiler 9. A valve V3 is provided in the pipe L25*a* and functions as a flow rate control valve, an opening/closing gate valve, or a pressure regulating valve. The nitrogen-containing liquid (LIN) fed to the reboiler 9 will be described in detail below.

(Low-Pressure Rectification Column)

The nitrogen-containing liquid (LIN) introduced into the upper-stage rectification portion 44 of the second rectification column 4 is rectified in the second rectification column 4. High-purity oxygen liquid drawn from the column bottom 41 of the second rectification column 4 is fed to the first condensing portion 3.

An argon-containing oxygen-rich substance (which may be gaseous, liquid or a gas-liquid mixture) is drawn via a pipe L42 from the lower-stage rectification portion 42 or an intermediate rectification portion 43 of the second rectification column 4, and is introduced into a column bottom 51 or a lower stage of a rectification portion 53 of the third rectification column 5 (first crude argon rectification column).

High-purity nitrogen gas (GAN) is drawn via a pipe L45 from a column top 45 of the second rectification column 4 and undergoes heat exchange in the subcooler E2, after which it is introduced into the main heat exchanger E1 to undergo heat exchange, and is then discharged as product nitrogen (nitrogen).

A gas is drawn via a pipe L43 from the upper-stage rectification portion 44 or the intermediate rectification portion 43 of the second rectification column 4 and undergoes heat exchange in the subcooler E2, after which it is introduced into the main heat exchanger E1 to undergo heat exchange, and is then discharged as a waste gas.

In this embodiment, the waste gas introduced into the main heat exchanger E1 via the pipe L322 and the pipe L43 (the pipe L43 which also merges with a pipe L811 from the third condensing portion 8) exits from an intermediate stage of the main heat exchanger E1 and is fed to an expansion turbine ET for use in driving the turbine, after which it is once again returned to the main heat exchanger E1 and expelled as waste gas.

(Crude Argon Rectification Column)

The third rectification column 5 rectifies the argon-containing oxygen-rich substance to obtain an argon-rich substance. The argon-rich substance (which may be gaseous, liquid or a gas-liquid mixture) is drawn out via a pipe L55 from an upper stage of the rectification portion 53 or a column top portion 55 of the third rectification column 5, and is introduced into a rectification portion 73 of the fourth rectification column 7 (pure argon rectification column). A rectified liquid of the argon-containing oxygen-rich substance is drawn via a pipe L51 from the column bottom 51 of the third rectification column 5, and is returned to the lower-stage rectification portion 42 or the intermediate rectification portion 43 of the second rectification column 4. A rectified gas (argon gas) of the argon-containing oxygen-rich substance is drawn via a pipe L52 from the column top 55 of the third rectification column 5, and fed to the second condensing portion 6 where it is condensed (liquefied), and then returned to the column top 55.

A rectified liquid of the oxygen-rich liquid drawn via a pipe L61 from a lower portion of the second condensing portion 6 is introduced into the intermediate rectification portion 43 of the second rectification column 4. A gas from the rectified liquid of the oxygen-rich liquid drawn from the column top of the second condensing portion 6 is introduced via a pipe L62 into the intermediate rectification portion 43 of the second rectification column 4.

(Pure Argon Rectification Column)

An argon-rich substance (which may be gaseous, liquid or a gas-liquid mixture) drawn from the rectification portion 53 or the column top 55 of the third rectification column 5 is introduced into the rectification portion 73 of the fourth rectification column 7 and rectified.

Argon gas drawn from a column top 75 of the fourth rectification column 7 is introduced into the third condensing portion 8. Argon liquid condensed in the third condensing portion 8 is returned to the fourth rectification column 7. The argon liquid stored in a column bottom 71 of the fourth rectification column 7 is fed to the reboiler 9. The gas from the reboiler 9 is introduced into the fourth rectification column 7.

The nitrogen-containing liquid (LIN) is introduced from the column top 25 of the first rectification column 2 via the pipe L25*a* as cold heat in the reboiler 9. The pressure of the liquid fed to the pipe L25*a* is regulated by the valve V3. The nitrogen-containing liquid (LIN) which has undergone heat exchange in the reboiler 9 is fed to the third condensing portion 8 via an introduction pipe L92. A decompression valve V4 is provided in the introduction pipe L92. The nitrogen-containing liquid (LIN) introduced into the third condensing portion 8 is utilized as cold heat in the third condensing portion 8. A gas (nitrogen-containing gas) is fed from the column top of the third condensing portion via a recycling pipe L81 to the intermediate rectification portion 43 or the upper-stage rectification portion 44 of the second rectification column 4.

Liquid argon (high-purity argon liquid LAr) can be extracted as product argon liquid from the lower portion of the reboiler 9 via a drawing pipe L91.

In this embodiment, the branch pipe L811 is provided branching from the recycling pipe L81. A gate valve V8 is provided in the recycling pipe L81, and a gate valve V7 is provided in the branch pipe L811.

The control unit C8 performs control to open the gate valve V7 and close the gate valve V8 so that the nitrogen-containing liquid (LIN) drawn from the third condensing portion 8 is fed to the branch pipe L811 for a predetermined period from the start of driving of the third condensing portion 8, and performs control to open the gate valve V8 and close the gate valve V7 so that the nitrogen-containing liquid (LIN) drawn from the third condensing portion 8 is fed to the recycling pipe L81 after the predetermined period has elapsed. The "predetermined period" is a time until stable driving is achieved, for example, and it may be set by a test run or experimental measurement, etc. The "predetermined period" is the time until the purity reaches 99% or more, for example, when the nitrogen gas concentration in the recycling pipe L81 is measured by a nitrogen gas concentration measuring unit (not depicted). A specific example of the "predetermined period" is a time of 12 hours, for example.

The branch pipe L811 merges with the pipe L43, and after the gas has undergone heat exchange in the subcooler E2, it is introduced into the main heat exchanger E1 for heat exchange, and then expelled as waste gas.

OTHER EMBODIMENTS (1) The oxygen-rich liquid drawn from the column bottom 21 of the first rectification column 2 may undergo heat exchange in the subcooler E2 and then be introduced into the intermediate rectification portion 43 of the second rectification column 4.

(2) The subcooler may or may not be provided.

(3) The main heat exchanger E1 may or may not be provided. Furthermore, a cleaning apparatus for cleaning the feed air may be provided upstream of the main heat exchanger E1.

(4) A thermometer, pressure gauge and liquid level gauge, etc. may be provided in each of the rectification columns.

(5) A thermometer, pressure gauge, flowmeter, and various types of valves (e.g., a pressure regulating valve, a flow rate regulating valve, a gate valve), etc. may be provided in each of the pipes.

(6) The expansion turbine ET need not be provided.

(7) The branch pipe L811 and the valve V7 need not be provided.

(8) The control unit C8 may control all of the various valves (gate valve V7, gate valve V8, etc.), and, as a different embodiment, a control unit for controlling the various valves may be provided correspondingly with each of the various valves. The control unit C8 may further control each of the control units for controlling the various valves.

EXAMPLE

In the configuration of FIG. 1, it was confirmed by a simulation that the nitrogen recovery rate improved by 1%-2% in an example in which recycling was performed in the recycling pipe L81, as compared to a comparative example in which no recycling was performed in the recycling pipe L81 and the material was expelled as waste gas in the pipe L811.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed.

Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

LIST OF REFERENCE NUMERALS

1 . . . Air separation apparatus
2 . . . First rectification column (high-pressure rectification column)
3 . . . First condensing portion
4 . . . Second rectification column (low-pressure rectification column)
5 . . . Third rectification column (crude argon rectification column)
6 . . . Second condensing portion
7 . . . Fourth rectification column (pure argon rectification column)
8 . . . Third condensing portion
9 . . . Reboiler
E1 . . . Main heat exchanger
E2 . . . Subcooler
L81 . . . Recycling pipe
L811 . . . Branch pipe
C8 . . . Control unit

What is claimed is:

1. A method for recovering nitrogen gas from a gas drawn from a condensing portion of a pure argon rectification column, the method comprising:

sending a cooled purified air stream to a first rectification column;

sending nitrogen enriched liquid from the first rectification column to a second rectification column having a bottom thermally linked to the top of the first rectification column, wherein the second rectification column further comprises a lower-stage rectification portion, an intermediate rectification portion, and an upper-stage rectification portion;

sending an argon-containing oxygen-rich fluid from the second rectification column to a crude argon rectification column;

sending an argon-rich fluid from the crude argon rectification column to a pure argon rectification column;

removing an argon rich stream from the pure argon rectification column;

vaporizing liquid nitrogen in the condensing portion of the pure argon rectification column;

removing a gaseous nitrogen product stream at a position between an upper-stage rectification portion and an intermediate rectification portion of the second rectification column; and sending vaporized liquid nitrogen from the condensing portion of the pure argon rectification column to the second rectification column, wherein the liquid nitrogen is the only liquid sent to the condensing portion of the pure argon rectification column, wherein the vaporized liquid nitrogen is sent to a point of the upper-stage rectification portion of the second rectification column, wherein the method further comprises a functioning-start time control step in which the gas drawn from the condensing portion of the pure argon rectification column is not recycled for a predetermined period after the start of functioning of the condensing portion of the pure argon rectification column, and the gas vaporized in the condensing portion of the pure argon rectification column is recycled to the second rectification column after the predetermined period has elapsed wherein the method further comprises the step of measuring a nitrogen concentration of the gas vaporized in the top condenser of the pure argon rectification column, wherein the predetermined period elapses when the measured nitrogen concentration reaches a predetermined purity threshold.

2. The method according to claim 1, wherein a nitrogen rich gas is removed from the first rectification column, condensed in a bottom reboiler of the fourth rectification column and vaporized in the condensing portion of the pure argon rectification column.

3. The method according to claim 1, wherein all the liquid vaporized in the condensing portion of the pure argon rectification column is sent to the second rectification column.

4. The method according to claim 1, wherein the point of the upper-stage rectification portion of the second rectification column that the vaporized liquid nitrogen is sent to is at a higher location than where the gaseous nitrogen product stream is withdrawn from.

5. The method according to claim 2, wherein the nitrogen rich gas removed from the first rectification column for said condensing in the bottom reboiler of the pure argon rectification column is drawn from a column top of the first rectification column, and wherein a high-purity liquid argon product is withdrawn from a lower portion of said bottom reboiler of the pure argon rectification column.

6. A method for recovering nitrogen gas from a gas drawn from a condensing portion of a pure argon rectification column, the method comprising:

sending a cooled purified air stream to a first rectification column;

sending nitrogen enriched liquid from the first rectification column to a second rectification column having a bottom thermally linked to the top of the first rectification column, wherein the second rectification column further comprises a lower-stage rectification portion, an intermediate rectification portion, and an upper-stage rectification portion;

sending an argon-containing oxygen-rich fluid from the second rectification column to a crude argon rectification column;

sending an argon-rich fluid from the crude argon rectification column to a pure argon rectification column;

removing an argon rich stream from the pure argon rectification column;

vaporizing liquid nitrogen in the condensing portion of the pure argon rectification column;

removing a gaseous nitrogen product stream at a position between an upper-stage rectification portion and an intermediate rectification portion of the second rectification column; and sending vaporized liquid nitrogen from the condensing portion of the pure argon rectification column to the second rectification column, wherein the liquid nitrogen is the only liquid sent to the condensing portion of the pure argon rectification column, wherein the vaporized liquid nitrogen is sent to a point of the upper-stage rectification portion of the second rectification column, wherein the method further comprises a functioning-start time control step in which the gas drawn from the condensing portion of the pure argon rectification column is not recycled for a predetermined period after the start of functioning of the condensing portion of the pure argon rectification column, and the gas vaporized in the condensing portion of the pure argon rectification column is recycled to the second rectification column after the predetermined period has elapsed, wherein during the predetermined period when the gas vaporized in the condensing portion of the pure argon rectification column is not recycled to the second rectification column, said gas is directed from the condensing portion of the pure argon rectification column via a branch pipe to a waste gas path.

7. The method according to claim 1, wherein the predetermined purity threshold is 99% nitrogen.

8. The method according to claim 2, wherein the liquid nitrogen, which is produced by condensing the nitrogen rich gas from the first rectification column in the bottom reboiler of the pure argon rectification column and is subsequently sent to be vaporized in the condensing portion of the pure argon rectification column, is passed through a decompression means located in an introduction pipe between said bottom reboiler and said condensing portion of the pure argon rectification column.

* * * * *